United States Patent [19]

Yates et al.

[11] 4,078,770

[45] Mar. 14, 1978

[54] WINCH WITH FREE-WHEELING DRUM

[75] Inventors: Lyle F. Yates, Metamora; Ray Shipman, Peoria; Charles E. Elgin, Brimfield, all of Ill.

[73] Assignee: Caterpillar Tractor Co., Peoria, Ill.

[21] Appl. No.: 662,320

[22] Filed: Mar. 1, 1976

Related U.S. Application Data

[63] Continuation-in-part of Ser. No. 334,354, Feb. 21, 1973, abandoned.

[51] Int. Cl.[2] ..... B66D 1/00

[52] U.S. Cl. ..... 254/187.5; 180/14 B

[58] Field of Search ..... 254/187 G, 187 H, 187 R, 254/166, 150 FH, 187.1, 187.4, 187.5; 180/14 B

[56] References Cited

U.S. PATENT DOCUMENTS

| | | | |
|---|---|---|---|
| 2,501,198 | 3/1950 | Wagner et al. | 254/187 G X |
| 3,027,141 | 3/1962 | Ellis | 254/166 |
| 3,070,324 | 12/1962 | Bryman | 254/166 |
| 3,249,336 | 5/1966 | Brown et al. | 254/187 H X |
| 3,325,149 | 6/1967 | Woodward | 254/187 H |
| 3,773,129 | 11/1973 | Anderson | 180/14 B |

*Primary Examiner*—Drayton E. Hoffman
*Assistant Examiner*—Donald W. Underwood
*Attorney, Agent, or Firm*—Phillips, Moore, Weissenberger, Lempio & Majestic

[57] ABSTRACT

A winch embodied as a logging or towing winch for vehicles such as a log skidder, the winch including a rotatable drum and a power train having an input member coupled to an engine of the vehicle, a normally disengaged clutch providing a selective coupling between the input member and an intermediate drive assembly, a normally engaged friction brake being selectively disengageable to permit rotation of the intermediate drive assembly and a jaw-type clutch normally providing a positive coupling between the intermediate drive assembly and the winch drum, the jaw clutch being selectively disengageable to permit free-wheeling of the drum.

8 Claims, 7 Drawing Figures

WINCH WITH FREE-WHEELING DRUM

CROSS-REFERENCE

This application is a continuation-in-part of our copending application Ser. No. 334,354 filed Feb. 21, 1973, now abandoned.

BACKGROUND OF THE INVENTION

The present invention relates to a winch which may be employed, for example, as a towing winch or a logging winch and more particularly to such a winch employing one or more clutches and a normally engaged brake to provide various operation functions in the winch, the winch being further adapted to permit free-wheeling of the winch drum.

Winches of the type contemplated by the present invention normally include a substantial number of rotating components to provide various desired operating functions as well as to insure against undesired rotation of the winch drum. For example, it is normally desirable to rotate the winch drum through clutch means for take-up of a line or cable which is trained about the winch drum. However, it is also necessary to enable an operator to secure the drum against rotation even while it is supporting a load upon the line. It is further desirable to prevent unwinding of the line or cable from the drum in the event that power from a driving engine should be interrupted for example.

The present invention also contemplates a problem arising particularly when such winches are employed for towing or logging operations for example. In such applications, it is often necessary to unreel or unwind the cable from the winch drum in order to secure it to logs, vehicles or other objects which are to be towed by a vehicle upon which the winch is mounted. Because of the numerous components included in such conventional winches, it tends to be difficult to manually unwind the cable due to excessive drag caused by the internal winch components.

SUMMARY OF THE INVENTION

Accordingly, it is an object of the present invention to provide a winch adapted to overcome one or more of the problems discussed above.

It is a more particular object of the present invention to provide a winch having a winch drum adapted for free-wheeling operation.

It is a further object of the invention to provide a winch including a normally disengaged clutch operable to provide a drive coupling for the drum, a normally engaged brake which must be released to permit rotation of the drum through the normally disengaged clutch and an additional jaw-type clutch providing a positive coupling to the winch drum, the jaw clutch being selectively disengageable to permit free-wheeling of the winch drum.

Additional objects and advantages of the present invention are made apparent in the following description having reference to the accompanying drawings.

BRIEF SUMMARY OF THE DRAWINGS

FIG. 6 is a schematic view illustrating the relative centers of rotation for various gears within the drive train. In comparing FIG. 6 particularly with FIG. 4, it may be noted that FIG. 4 is a generally developed view which may be considered as a section view through the center lines of the shafts in FIG. 6. Accordingly, although certain gear components within the drive train are arranged in meshing engagement as illustrated in FIG. 6, those components may tend to be removed from meshing engagement in the developed view of FIG. 4.

DETAILED DESCRIPTION OF A PREFERRED EMBODIMENT

Figure 1:
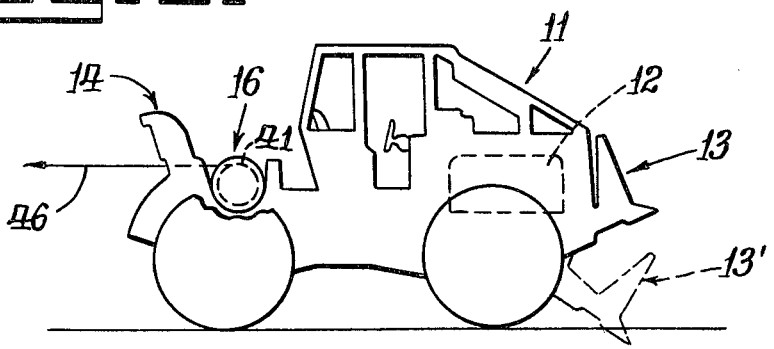
FIG. 1 is a side elevation view of a log skidder vehicle including a towing or logging winch constructed according to the present invention.

A winch constructed according to the present invention is particularly adapted for use as a towing or logging winch in a log skidder vehicle of the type illustrated at 11 in FIG. 1. Such a vehicle includes a prime mover or engine as illustrated in phantom at 12. To adapt the vehicle for logging operations, it may include a bulldozer mounted upon one end of the vehicle for movement between a raised position illustrated in solid lines at 13 and a lowered position illustrated in phantom at 13'. To adapt the vehicle for towing operations, it includes an arch arranged upon the other end of the vehicle as illustrated at 14 and a winch illustrated at 16 and constructed according to the present invention. Construction and operation of the winch 16 is described in greater detail below having reference to the other figures.

Figure 2:
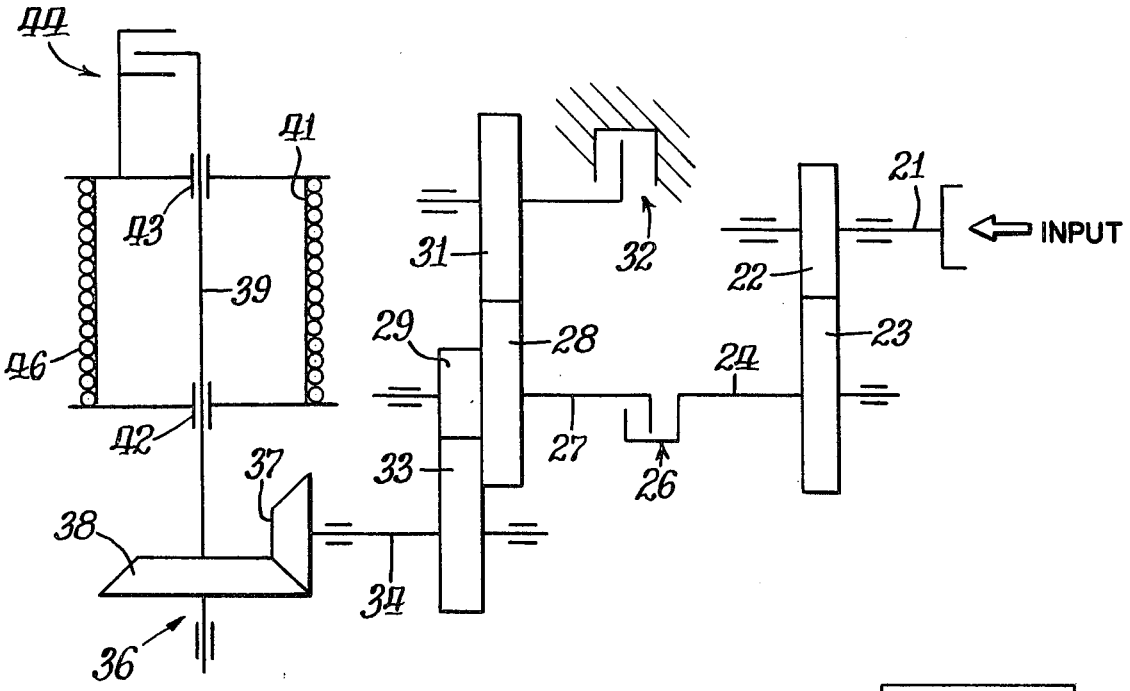
FIG. 2 is a schematic representation of the drum and drive train included within the winch.
Figure 5:
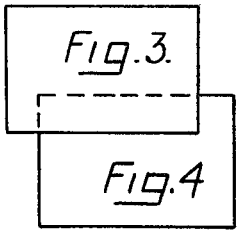
FIG. 5 represents the arrangement of FIGS. 3 and 4 to show the manner in which the intermediate portion of the drive train in FIG. 4 is associated with the output portion of the drive train as illustrated in FIG. 3.

Referring particularly to FIG. 2, a power train for the winch includes a power input shaft 21 which may comprise a standard power take-off from the prime mover 12 of the vehicle in FIG. 1, for example. The input shaft 21 is coupled by means of meshing transfer gears 22 and 23 with an input shaft 24 for a normally disengaged friction clutch 26. An output shaft 27 for the clutch 26 is coupled with a clutch output gear 28 which is secured for rotation with a transfer gear 29. The clutch output gear 28 meshes with a brake gear 31 with a normally engaged friction brake 32 being operable to secure the brake gear 31 against rotation.

The components described above in engagement with the input shaft 21 comprise an intermediate portion of the drive train. The normally disengaged clutch 26 permits driving operation of the gear components within the intermediate drive train by the input 21. The normally engaged brake 32 in operation tends to be disengaged as the clutch 26 is engaged, or conversely tends to be engaged as the clutch 26 is disengaged. Thus, the brake 32 normally serves to prevent rotation of the intermediate drive train or at least those components on the output side of the clutch 26 when the clutch 26 is disengaged.

An output portion of the winch drive train includes a transfer gear 33 arranged in meshing engagement with the gear 29. The gear 33 is mounted upon an input shaft 34 for a bevel gear assembly 36 having bevel gears 37 and 38. A winch drum shaft 39 provides an output for the bevel gear assembly 36 with a winch drum 41 being arranged for rotation upon the shaft 39 by means of bearings 42 and 43.

According to the present invention, a jaw-type clutch 44 is normally engaged to provide a coupling between the winch drum shaft 39 and the drum 41 while being selectively disengageable to permit free-wheeling of the drum 41.

Figure 4:
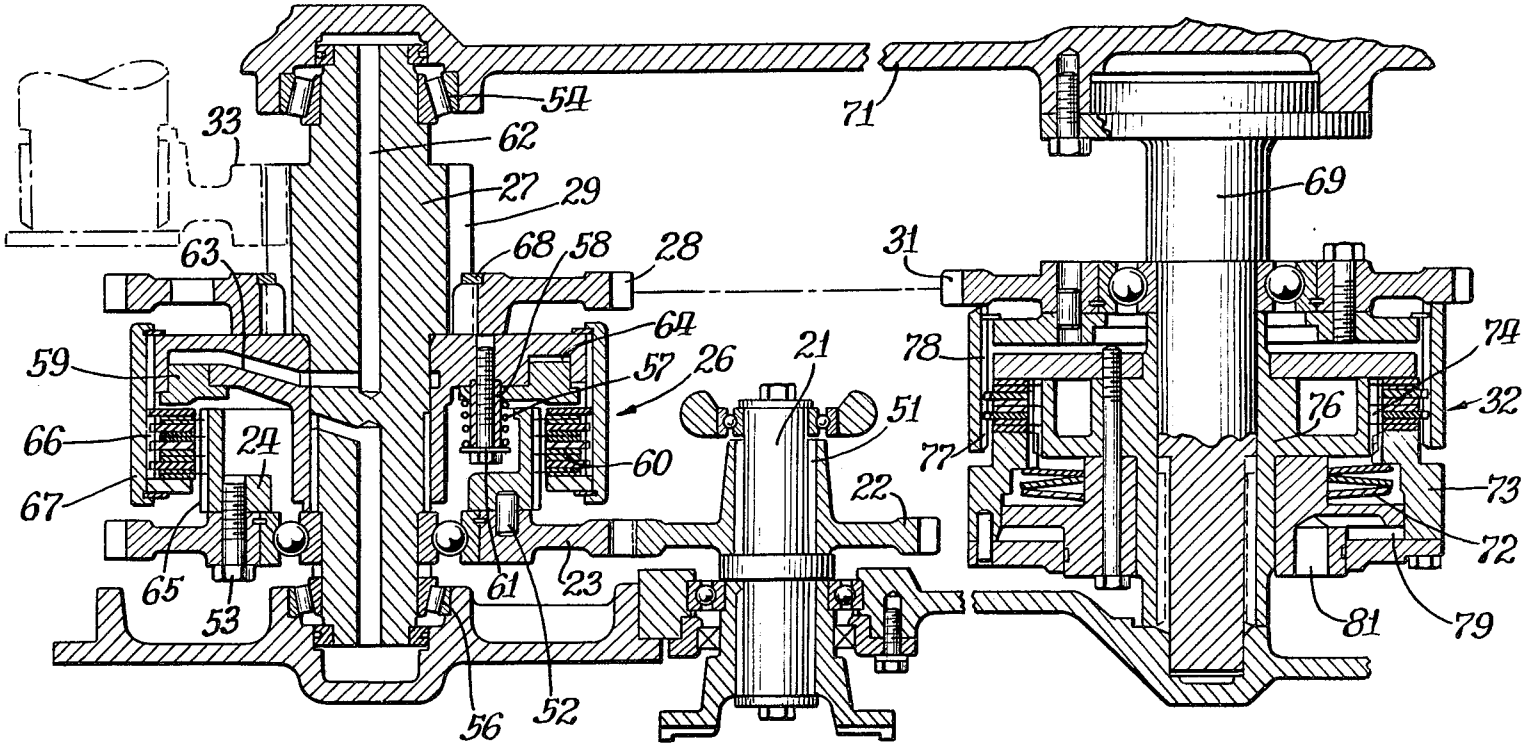
Figure 5:
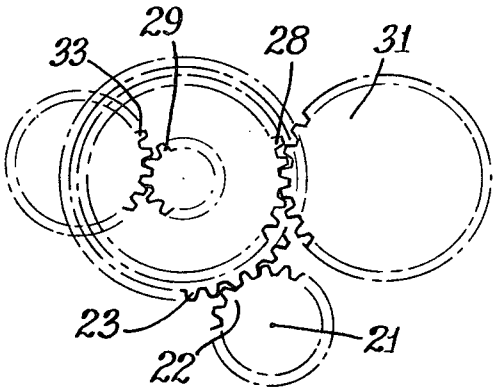

To describe features of the drive train in greater detail, having reference initially to FIG. 4, the transfer gear 22 is connected to the input shaft 21 through splines 51 while the gear 23 is integrally secured to the clutch hub or input shaft 24 by pins 52 and a plurality of bolts 53.

The entire rotating clutch means 26 is supported by its output shaft 27 and bearings 54 and 56. The rotating clutch means 26 is normally disengaged by the force of a plurality of springs 57 assembled upon a sleeve 58 between a piston 59 and a washer 61.

In operation, the clutch 26 is hydraulically engaged by fluid pressure entering through passages 62 and 63 from a control valve (not shown) to a chamber 64. Thus, piston 59 is shifted to engage conventional disc-type plates 60 wherein alternate discs are connected internally to splines 65 on the clutch hub 24 and externally to splines 66 on a ring gear 67. The clutch output gear 28 is mounted on the output shaft 27 along with the transfer gear 29 and retained thereon by a lock ring 68.

As shown in FIG. 6, the output gear 28 meshes with the brake gear 31 while the brake 32 functions in association with the gear 31 to selectively slip or gradually release a load and to hold a load as desired.

Referring again to FIG. 4, the brake 32 is supported by a stationary shaft 69 mounted in a housing 71. The brake 32 is normally engaged by force from a set of Belleville springs 72, causing a clutch actuating member 73 to engage conventional multiple disc-type plates with alternate discs being connected internally to splines 74 on a clutch hub 76 and externally to spline teeth 77 on a ring gear 78. The brake 32 is disengaged by fluid under pressure entering a chamber 79 through a passage 81 to move the clutch engaging member 73 downwardly in order to disengage or slip the brake so that the load can be more safely lowered.

Figure 3:
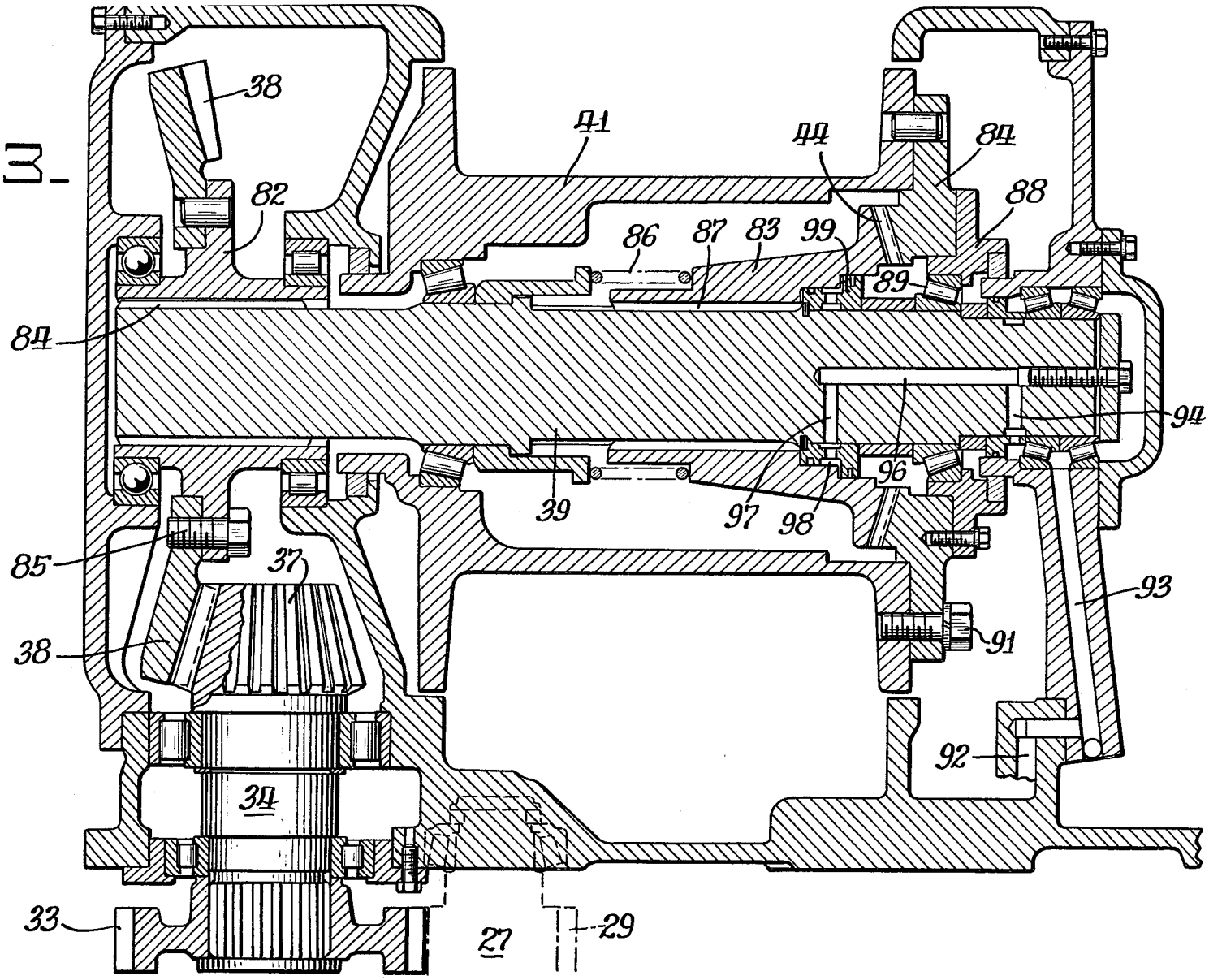
FIGS. 3 and 4 are sectional views of the winch drive train, FIG. 3 illustrating an output portion of the drive train together with the rotatable winch drum, FIG. 4 illustrating an input and intermediate portion of the drive train including a normally disengaged clutch and a normally engaged brake.

Referring to FIG. 3, the transfer gear 29 mounted on the shaft 27 meshes with the transfer gear 33 to drive the bevel pinion shaft 34. Further speed reduction is provided between bevel pinion gears 37 and 38. The bevel gear 38 is connected to the winch drum shaft 39 by an adaptor 82 and bolts 85.

The face-type jaw clutch 44 consists of a drive member 83 and a driven member 84 which are normally engaged by the assembled load of a spring 86. The jaw clutch drive member 83 is supported by a sliding spline 87 while the driven member 84 is supported by an adaptor 88 and bearing means 89. The jaw clutch driven member 84 is also connected to the winch drum 41 by bolts 91.

To provide free-wheeling rotation of the drum 41, fluid pressure is admitted by a passage 92 and flows through passages 93, 94, 96 and 97 to a pressure chamber 98. As fluid pressure increases in the chamber 98 and also due to differential areas of a sleeve 99, the drive member 83 moves leftwardly on the sliding spine 87 against the spring force to completely separate the jaw faces on the clutch members 83 and 84.

When the jaw clutch drive member 83 is separated from the driven member 84, the winch drum 41 is completely disconnected from the drive train components to allow an operator to freely rotate the drum 41 and unwind the cable 46 with minimum effort.

Figure 7:
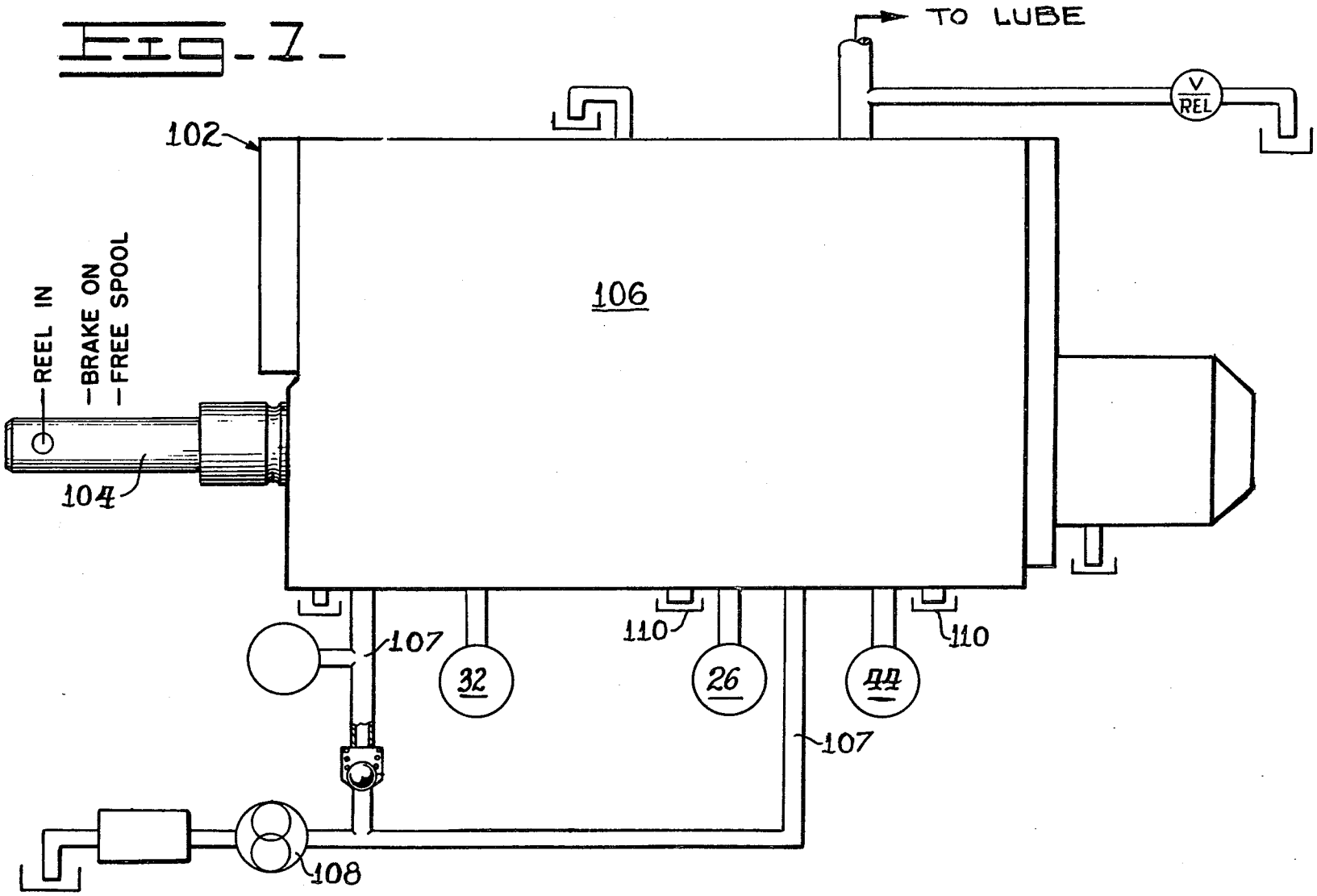
FIG. 7 illustrates schematically control means for the clutches and brake of FIG. 2.

Turning now to FIG. 7, there is illustrated schematically therein clutch and brake control means, in the embodiment illustrated a clutch and brake control system 102. Reference may be had to application Serial No. 334,353, now U.S. Patent 3,811,608, filed the same day as the parent application, Serial No. 334,354, of the present application and commonly assigned herewith for a detailed description of a control system which, will perform all the necessary functions of the control system 102 of the present invention. Other control systems providing like functions are likewise usable. Briefly, the control system 102 is shiftable between a REEL IN position, a BRAKE ON position, and a FREE SPOOL position through movement of a regulating spool 104 within a control body 106. The spool 104 controls fluid communication between a pressurizing conduit 107 which is pressurized directly by a pressurized fluid source, i.e., a pump 108 in the embodiment illustrated, and the clutch 26, the brake 32 and the jaw-type clutch 44. The control system 102 in the REEL IN position applies pressure to release the normally engaged friction brake 32 and, at the same time, applies pressure to engage the normally disengaged clutch 26. Pressure is not supplied to the normally engaged jaw-type clutch 44 whereby it remains engaged and reeling in of the cable 46 proceeds. In the BRAKE ON position of the regulating spool 104, each of clutch 26, brake 32 and jaw-type clutch 44 are connected to drain (a sump 110) and, hence, each are in their normal position, i.e., the clutch 26 is disengaged, the brake 32 is engaged and the jaw-type clutch 44 is engaged. In the FREE SPOOL position of the regulating spool 104, the brake 32 is disengaged due to pressure being applied thereto while the clutch 26 is disengaged since pressure is not applied thereto and the jaw-type clutch 44 is disengaged since pressure is applied thereto thus allowing free wheeling of the winch drum 41. It is thus clear that the control system 102 controls application of fluid pressure to the jaw-type clutch 44 independently of its control of application of fluid pressure to the input friction clutch 26 and the friction brake 32 to disengage the jaw-type clutch 44 to effect free wheeling of the winch drum 41.

While the invention has been described in connection with specific embodiments thereof, it will be understood that it is capable of further modification, and thus application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. In a machine having engine means, a winch comprising a rotatable winch drum and a power train including a rotatable power input member coupled to the engine means, an intermediate drive means, a normally disengaged input friction clutch which is selectively engageable to provide a coupling between the input member and intermediate drive means, a friction brake being normally engaged to secure the intermediate drive means against rotation and being selectively disengageable to permit rotation of the intermediate drive means, a jaw-type clutch being normally engaged to provide a positive coupling between the intermediate drive means and the winch drum, the jaw clutch being selectively disengageable to permit free-wheeling of the winch drum free of drag from the intermediate drive means, a source of fluid pressure, conduit means connecting said source of fluid pressure to said normally disengaged input friction clutch and to said friction brake and to said jaw-type clutch, means controlling said fluid pressure to said input friction clutch for engaging the same and simultaneously disengaging said friction brake whereby said winch is driven from said engine means, and means controlling said fluid pressure to said jaw-type clutch independent of said means controlling fluid pressure to said input friction clutch and said friction brake for disengaging the same to effect free wheeling of said winch drum.

2. A winch as in claim 1, wherein the machine is a vehicle with the engine means providing a prime mover for the vehicle, the winch being adapted to provide a towing function for the vehicle.

3. A winch as in claim 2, wherein the normally disengaged input friction clutch is arranged along a direct drive path between the input member and the rotatable winch drum, the normally engaged friction brake being arranged upon a branch of the drive path on the output side of the friction clutch.

4. A winch as in claim 3, wherein the normally disengaged input friction clutch, the normally engaged friction brake and the jaw-type clutch are all hydraulically operated.

5. A winch as in claim 4, wherein the winch drum is mounted in relatively rotatable relation upon a winch drum shaft coupled for rotation with the power train, the jaw-type clutch being arranged to selectively provide a positive coupling between the winch drum and the winch drum shaft.

6. A winch as in claim 5, wherein the jaw-type clutch is disposed interiorly of said drum and includes a spring urging the clutch in engagement with said shaft.

7. In a machine comprising engine means, a winch comprising a rotatable winch drum, a rotatable power input member coupled to the engine means, an input clutch, a brake, a winch engaging clutch, pressurized fluid for operating said input clutch, said friction brake and said winch engaging clutch, and pressurized fluid control means controlling application of said pressurized fluid to said input clutch, said friction brake and said winch engaging clutch, an improvement comprising:

1. utilizing as said input clutch a friction clutch which is normally disengaged when said pressurized fluid is not applied thereto and is selectively engageable on application of fluid pressure thereto to provide coupling between said input member and an intermediate drive means located between said input clutch and said winch engaging clutch;

2. utilizing as said brake a friction brake which is normally engaged when said pressurized fluid is not applied thereto and is selectively disengageable on application of fluid pressure thereto to release said intermediate drive means and permit rotation thereof;

3. utilizing as said pressurized control means, first fluid control means controlling application of fluid pressure to said friction brake and said friction clutch and second fluid control means operating independently of said first fluid control means, said second fluid control means controlling application of fluid pressure to said winch engaging clutch; and

4. utilizing as said winch engaging clutch a jaw type clutch which is normally engaged when said pressurized fluid is not applied thereto to provide a positive coupling between said intermediate drive means and the winch drum and is selectively disengageable to permit free-wheeling of the winch drum free of drag from the intermediate drive means on application of pressurized fluid to said jaw-type clutch.

8. An improvement as in claim 7, including speed reduction means intermediate said intermediate drive means and said jaw-type clutch to cause said intermediate drive means to operate under reduced torque.

* * * * *